US011519357B2

(12) United States Patent
Zurk et al.

(10) Patent No.: US 11,519,357 B2
(45) Date of Patent: Dec. 6, 2022

(54) INTERNAL COMBUSTION ENGINE HAVING AT LEAST ONE CYLINDER

(71) Applicant: AVL LIST GmbH, Graz (AT)

(72) Inventors: Andreas Zurk, Weinburg (AT); Martin Klampfer, Hitzendorf (AT); Robert Grundner, Graz (AT)

(73) Assignee: AVL LIST GMBH, Graz (AT)

( * ) Notice: Subject to any disclaimer, the term of this patent is extended or adjusted under 35 U.S.C. 154(b) by 0 days.

(21) Appl. No.: 17/439,788

(22) PCT Filed: Mar. 20, 2020

(86) PCT No.: PCT/EP2020/057721
§ 371 (c)(1),
(2) Date: Sep. 15, 2021

(87) PCT Pub. No.: WO2020/188071
PCT Pub. Date: Sep. 24, 2020

(65) Prior Publication Data

US 2022/0170428 A1 Jun. 2, 2022

(30) Foreign Application Priority Data

Mar. 20, 2019 (AT) ..... A 50244/2019

(51) Int. Cl.
*F02F 1/40* (2006.01)
*F01P 3/02* (2006.01)
(Continued)

(52) U.S. Cl.
CPC *F02F 1/40* (2013.01); *F01P 3/02* (2013.01); *F01P 3/14* (2013.01); *F01P 3/16* (2013.01);
(Continued)

(58) Field of Classification Search
CPC ..... F02F 1/16; F02F 1/14; F02F 1/40; F01P 3/02; F01P 2003/024; F01P 2003/027; F01P 3/12; F01P 3/14; F01P 3/16
See application file for complete search history.

(56) References Cited

U.S. PATENT DOCUMENTS 3,377,996 A * 4/1968 Anderson ..... F02F 1/40 123/41.31
6,681,727 B2 1/2004 Krenn
(Continued)

FOREIGN PATENT DOCUMENTS

AT 501008 A2 5/2006
DE 102010033710 A1 2/2012
(Continued)

*Primary Examiner* — Hung Q Nguyen
(74) *Attorney, Agent, or Firm* — Dykema Gossett PLLC

(57) ABSTRACT

Various embodiments of the present disclosure are directed to an internal combustion engine cylinder head. In one example embodiment, the cylinder head includes a combustion chamber, a fire deck, an intermediate deck remote from a combustion chamber, a central receptacle that receives an injection or ignition device, at least one valve bridge, at least two adjacent gas exchange valves, a top-down cooling system, at least one first transfer opening, and at least one second transfer opening. The top-down cooling system including a first sub-cooling chamber and a second sub-cooling chamber. The at least one first transfer opening positioned between the first sub-cooling chamber and the second sub-cooling chamber. The at least one second transfer opening positioned between the first sub-cooling chamber and the second sub-cooling chamber is arranged in the region in the region of the at least one valve bridge between the at least two adjacent gas exchange valves.

17 Claims, 3 Drawing Sheets

(51) Int. Cl.
*F01P 3/14* (2006.01)
*F01P 3/16* (2006.01)
*F02F 1/24* (2006.01)

(52) U.S. Cl.
CPC ..... *F02F 1/242* (2013.01); *F01P 2003/024* (2013.01)

(56) References Cited

U.S. PATENT DOCUMENTS

| | | | | |
|---|---|---|---|---|
| 6,899,063 | B2 | 5/2005 | Obermayer et al. | |
| 9,447,748 | B2 * | 9/2016 | Alexander | F02F 1/10 |
| 10,047,660 | B2 | 8/2018 | Petutschnig et al. | |
| 2002/0129776 | A1 | 9/2002 | Krenn | |
| 2004/0139933 | A1 * | 7/2004 | Obermayer | F01P 3/16 123/193.5 |
| 2005/0193966 | A1 * | 9/2005 | Mac Vicar | F02F 1/38 123/41.82 R |
| 2009/0314230 | A1 * | 12/2009 | Nagenkogl | F01M 13/04 123/573 |
| 2010/0132639 | A1 * | 6/2010 | Poschl | F02F 1/242 123/41.82 R |
| 2014/0020639 | A1 * | 1/2014 | Poschl | F02F 1/40 123/41.34 |
| 2015/0211408 | A1 * | 7/2015 | Maier | F02F 1/16 123/41.82 R |
| 2016/0356201 | A1 * | 12/2016 | Petutschnig | F02F 1/40 |

FOREIGN PATENT DOCUMENTS

| | | | |
|---|---|---|---|
| EP | 3379063 | A1 | 9/2018 |
| WO | 2008122544 | A1 | 10/2008 |
| WO | 2012004340 | A1 | 1/2012 |
| WO | 2018037368 | A1 | 3/2018 |

* cited by examiner

INTERNAL COMBUSTION ENGINE HAVING AT LEAST ONE CYLINDER

CROSS-REFERENCE TO RELATED APPLICATIONS

This application is a national stage filing based upon International application No. PCT/EP2020/057721, filed 20 Mar. 2020, which claims the benefit of priority to Austria application No. A 50244/2019, filed 30 Mar. 2019.

BACKGROUND

The invention relates to a cylinder head for an internal combustion engine having at least one cylinder with a top-down cooling system, having a first sub-cooling chamber, which adjoins an intermediate deck and is remote from the combustion chamber, and a second sub-cooling chamber, which adjoins a fire deck and is close to the combustion chamber, wherein the intermediate deck is arranged between the first sub-cooling chamber and the second sub-cooling chamber, and wherein at least one preferably annular first transfer opening is arranged between the first sub-cooling chamber and the second sub-cooling chamber in the region of a central receptacle for an injection or ignition device, wherein preferably the central receptacle is formed concentrically relative to a cylinder axis of the cylinder. Furthermore, the invention relates to a method for cooling the cylinder head.

In cylinder heads with two cooling chambers arranged one above the other, top-down cooling is a cooling concept in which the coolant flows from the upper cooling chamber through transfer openings into the lower cooling chamber, wherein the coolant inlet is arranged in the area of the upper cooling chamber and the coolant outlet in the area of the lower cooling chamber.

Cylinder heads that operate according to the top-down cooling concept are known, for example, from U.S. Pat. No. 10,047,660 B2, WO 2012/004340 A1 or WO 2018/037368 A1.

The publications U.S. Pat. Nos. 6,681,727 B2 and 6,899,063 B2 describe cylinder heads having an upper and a lower cooling chamber which are separated from each other by an intermediate deck. In the region of the central receptacles for a fuel injection device in each case, transfer openings are arranged in the intermediate decks to connect the two cooling chambers with each other in terms of flow. In addition, one degassing opening per cylinder is provided in the intermediate deck to prevent the accumulation of vapor bubbles in the lower cooling chamber. Each degassing opening is located in the region of a transverse plane through the cylinder axis radially outside a valve bridge and is further away from the cylinder axis than the axes of the gas exchange valves.

It is the object of the invention to improve cooling in thermally highly stressed parts of the cylinder head.

SUMMARY OF THE INVENTION

Based on a cylinder head of the type mentioned at the beginning, this object is solved according to the invention in that at least one second transfer opening is arranged between the first sub-cooling chamber and the second sub-cooling chamber in the region of at least one valve bridge between two adjacent gas exchange valves.

It is advantageous if the first sub-cooling chamber is arranged above the second sub-cooling chamber in such a way that coolant flows from the first sub-cooling chamber via the first transfer opening and at least one second transfer opening in the region between two adjacent gas exchange valves into the second sub-cooling chamber. Top-down cooling is thus implemented. Coolant flows from the upper (first) sub-cooling chamber into the lower (second) sub-cooling chamber.

It is further advantageous if the first transfer opening is formed with an especially continuous taper in the direction of the second sub-cooling chamber. In particular, this taper is designed in such a way that it extends into the central element, i.e. material is removed from the central element. In principle, the taper can also be formed unevenly, in which case it consists of several adjoining partial elements with different angles of inclination. In particular, the taper is produced by conical machining of the cylinder head.

The at least one second transfer opening can advantageously be designed and arranged parallel to the cylinder axis or inclined against a flow direction of the coolant (in particular in a range of 0° and 45° deviating from a cylinder axis).

However, it is particularly preferred if the second transfer opening is inclined in the direction of a flow direction of the coolant in the valve bridges, with an inclination deviating from a cylinder axis by about 0° to about 45°, in particular by about 15° and about 30°. This inclination of the transfer opening enables a particularly efficient flow of the coolant, as a result of which the valve bridges and the entire cylinder head are cooled particularly efficiently. A distance of the second transfer opening is preferably about 15% to about 40% of a diameter of a cylinder bore. Furthermore, the at least second transfer opening can be arranged either centrally or decentrally with respect to a valve bridge. If more than one second transfer opening is provided per valve bridge, it can be advantageous if these have an offset with respect to a longitudinal direction of the valve bridge.

At least one second transfer opening is advantageously arranged above a local hot spot of the fire deck and is preferably directed towards it. This ensures efficient heat dissipation. A local hot spot is defined as a thermally stressed area of the fire deck with local temperature peaks, e.g. valve bridges of the fire deck between two outlet valves or between an outlet valve and an inlet valve of the gas exchange valves.

The separate second transfer openings allow a targeted inflow and thus improved cooling in the desired area. In addition, the second transfer opening can also be used for degassing when the engine is not running.

The second transfer opening can be manufactured by a casting process or in a material-removing manufacturing step. For ease of manufacture, it is advantageous if the second transfer opening is arranged essentially parallel to the cylinder axis.

In the context of the invention, a top-down cooling system as described above is understood to mean a cooling system in which, in the case of cylinder heads with two cooling chambers arranged one above the other, the coolant flows from the upper cooling chamber through transfer openings into the lower cooling chamber, wherein the coolant inlet is arranged in the region of the upper cooling chamber and the coolant outlet in the region of the lower cooling chamber.

The second sub-cooling chamber thus adjoins both the fire deck and the intermediate deck. The intermediate deck thus separates the first sub-cooling chamber and the second sub-cooling chamber, wherein these are flow-connected by the first and at least one second transfer opening. The first transfer opening is in particular annular in shape and is preferably arranged concentrically around the central receptacle. In other words, the first transfer opening permits a flow transfer between the first and second sub-cooling chambers in the entire region radially around the central receptacle.

Preferably, the distance between at least one second transfer opening and the cylinder axis is 15% to 40%, preferably 20% to 25%, particularly preferably about 20% of the diameter of the cylinder. This distance enables, on the one hand, particularly efficient cooling and, on the other hand, relatively simple production of the cylinder head. In the context of the invention, a diameter of the cylinder is understood in particular to mean a cylinder bore diameter. The transfer openings are formed and arranged for the transfer of cooling water. Particularly preferably, a distance of a cooling water transition around the sleeve is about 10% to 20% of the cylinder bore diameter.

In a further embodiment of the invention, it is provided that at least one second transfer opening is arranged in the region of a first valve bridge and at least one further second transfer opening is arranged in the region of a second valve bridge. In one embodiment of the invention, at least one second transfer opening is arranged in the region of a first valve bridge, in the region of a second valve bridge and in the region of a third valve bridge, and preferably also in the region of a fourth valve bridge. This enables a uniform coolant flow and thus uniform and efficient cooling of regions subject to high thermal loads.

One embodiment variant of the invention provides that at least two second transfer openings are equidistant from the cylinder axis. In particular, it can be provided that the centers of at least three second transfer openings lie on a circular line around the cylinder axis, the diameter of which is 30% to 80%, preferably 35% to 50%, particularly preferably about 40% of the diameter of the cylinder. Simulations within the scope of the invention have shown that particularly effective flow and cooling can be achieved in this way.

In one embodiment variant of the invention, it is provided that the distance between at least a second transfer opening and the cylinder axis is smaller than the distance between the valve axis of an adjacent gas exchange valve and the cylinder axis.

The ratio of the sum of the cross-sections of the first flow transfers to the sum of the cross-sections of the second flow transfers is basically dependent on a number of the separate transfers and/or on undesirable heat inputs into the cylinder head.

The cylinder head is cooled by coolant flowing into the first sub-cooling chamber of the cylinder head, at least part of the coolant flowing from the first sub-cooling chamber via at least one first transfer opening in the region of the central receptacle for an injection or ignition device into the second sub-cooling chamber, and the coolant exiting the cylinder head after flowing through the second sub-cooling chamber. According to the invention, at least a further part of the coolant flows from the first sub-cooling chamber into the second sub-cooling chamber via at least one second transfer opening in the region of at least one valve bridge between two adjacent gas exchange valves.

The second transfer openings are subject to fewer tolerance influences between the first sub-cooling chamber and the second sub-cooling chamber compared to cast first transfer openings.

The exact position of the second transfer openings can be adapted to the respective cooling requirements in each case. In doing so, it is possible to generate very high turbulence in the desired areas and improve heat dissipation.

BRIEF DESCRIPTION OF THE DRAWING

The invention is explained in more detail below with reference to the non-limiting figures, wherein.

DETAILED DESCRIPTION

Figure 1:
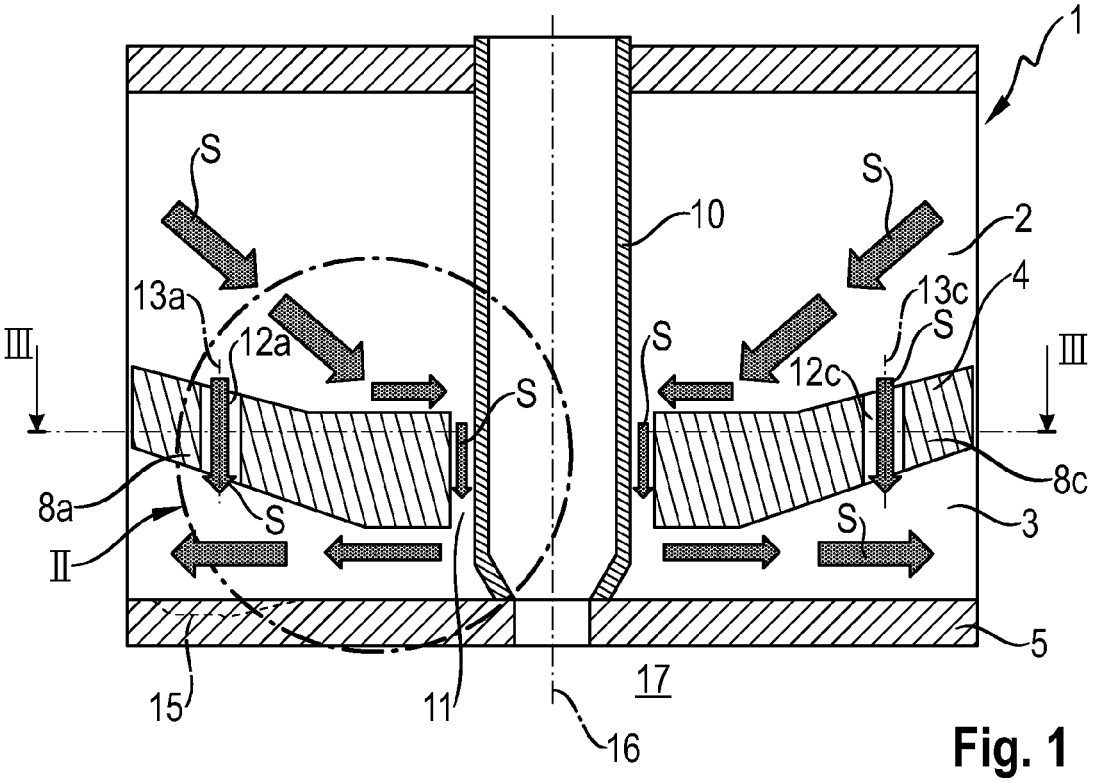
FIG. 1 shows a cylinder head according to the invention in a section according to line I-I in FIG. 3.
Figure 2:
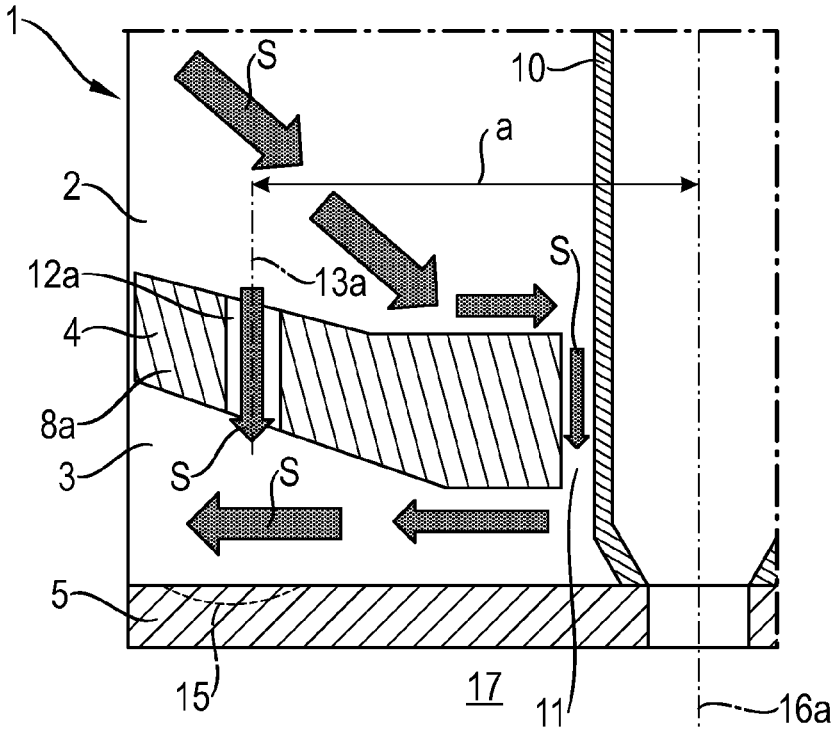
FIG. 2 shows detail II from FIG. 1.
Figure 3:
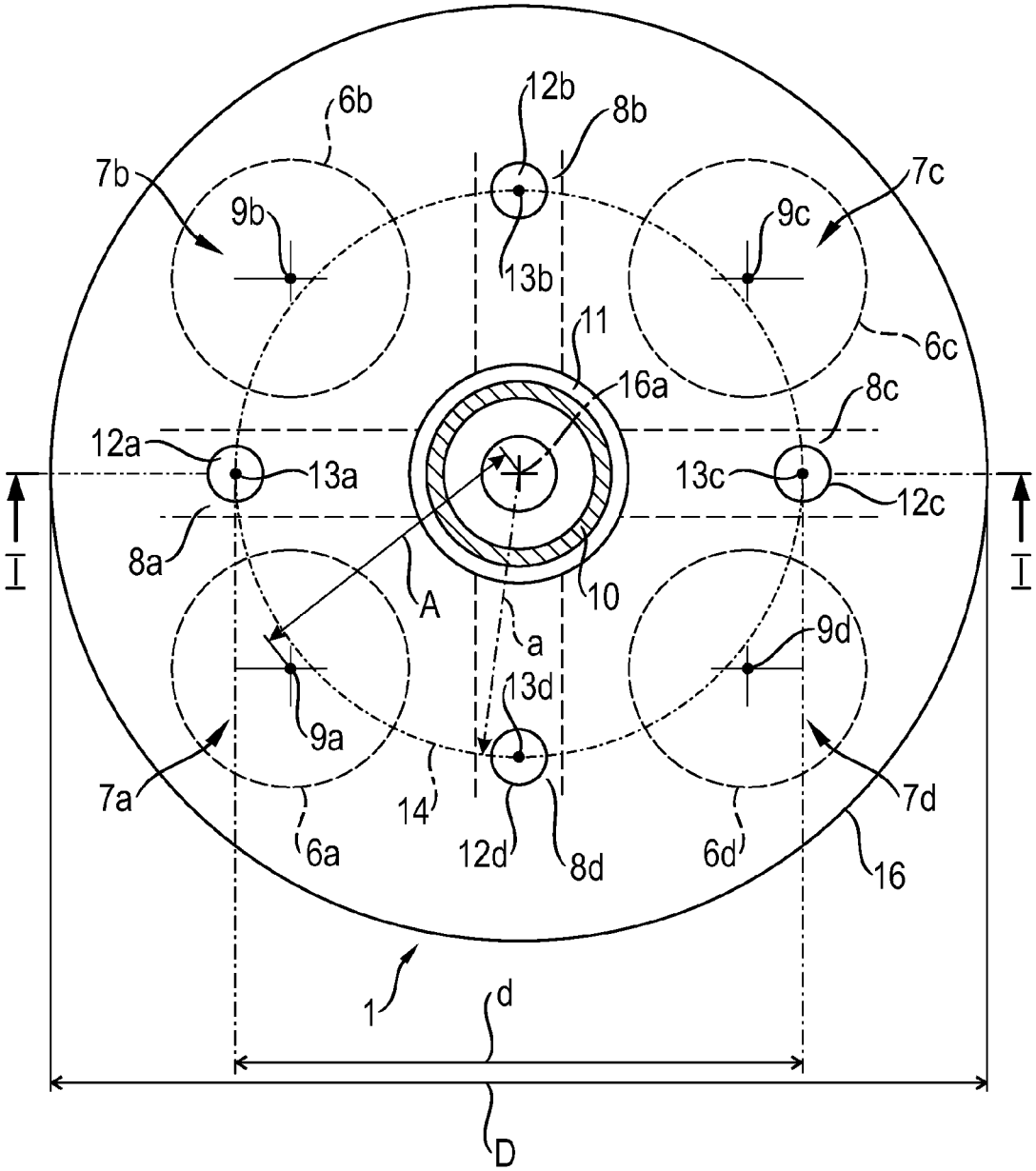
FIG. 3 shows the cylinder head in a section according to line III-III in FIG. 1.

FIGS. 1 to 3 show a cylinder head 1 designed for one or more cylinders 16. FIGS. 1 to 3 each show the cylinder head 1 with one cylinder 16.

The cylinder head 1, which is designed with a top-down cooling system, has an upper first sub-cooling chamber 2, i.e. remote from the combustion chamber, and a lower second sub-cooling chamber 3, i.e. close to the combustion chamber, wherein the first sub-cooling chamber 2 is separated from the second sub-cooling chamber 3 by an intermediate deck 4. The second sub-cooling chamber 3 adjoins the fire deck 5 forming a combustion chamber ceiling. The combustion chamber adjoining the fire deck 5 is indicated by reference sign 17.

A number of valve openings 6*a*, 6*b*, 6*c*, 6*d* for gas exchange valves 7*a*, 7*b*, 7*c*, 7*d* opening into the combustion chamber 17 are arranged in the fire deck 5 for each cylinder 16. The gas exchange valves 7*a*, 7*b*, 7*c*, 7*d* form inlet valves for supplying air or an air-fuel mixture to the combustion chamber and outlet valves for discharging exhaust gases from the combustion chamber 17. Valve bridges 8*a*, 8*b*, 8*c*, 8*d* are arranged between the valve openings 6*a*, 6*b*; 6*b*, 6*c*; 6*c*, 6*d*; 6*d*, 6*a* of adjacent gas exchange valves 7*a*, 7*b*, 7*c*, 7*d*.

In the region of the cylinder axis 16*a*, the cylinder head 1 has a central receptacle 10, formed for example by an inserted sleeve, for a central element, for example a spark plug or an injection device. The central receptacle 10 is formed concentrically to the cylinder axis 16*a*, for example. In the region of the central receptacle 10, at least one first transfer opening 11 is arranged between the first sub-cooling chamber 2 and the second sub-cooling chamber 3, which in the embodiment example is formed by an annular gap between the intermediate deck 4 and the receptacle 10.

In addition to the first transfer opening 11, a second transfer opening 12*a*, 12*b*, 12*c*, 12*d* is arranged in the region of at least one, preferably each, valve bridge 8*a*, 8*b*, 8*c*, 8*d* at a distance from the cylinder axis 16*a* of the cylinder 16. The second transfer openings 12*a*, 12*b*, 12*c*, 12*d* are formed parallel to the cylinder axis 16*a*. The centers 13*a*, 13*b*, 13*c*, 13*d* of the second transfer openings 12*a*, 12*b*, 12*c*, 12*d* are arranged on a circular line 14 around the cylinder axis 16*a*, the diameter d of which is between 30% to 80%, for example 50%, of the diameter D of the cylinder 16. The distance a between the center 13*a*, 13*b*, 13*c*, 13*d* of at least one second transfer opening 12*a*, 12*b*, 12*c*, 12*d* and the cylinder axis 16*a* is smaller in the exemplary embodiment than the distance A between a valve axis 9*a*, 9*b*, 9*c*, 9*d* of an adjacent gas exchange valve 7*a*, 7*b*, 7*c*, 7*d* and the cylinder axis 16*a*. In other words, the centers 13*a*, 13*b*, 13*c*, 13*d* of the second transfer openings 12*a*, 12*b*, 12*c*, 12*d* are arranged closer to the cylinder axis 16*a* in the exemplary embodiment than the valve axes 9*a*, 9*b*, 9*c*, 9*d* of the nearest gas exchange valves 7*a*, 7*b*, 7*c*, 7*d*.

As can be clearly seen from FIG. 2, at least one second transfer opening 12*a*, 12*b*, 12*c*, 12*d* is directed towards a hot spot 15 of the nearest valve bridge 8*a*, 8*b*, 8*c*, 8*d* of the fire deck 5. The separate second transfer openings 12*a*, 12*b*, 12*c*, 12*d* thus enable a targeted inflow and thus improved cooling in the desired area.

As indicated by the arrows S in FIGS. 1 and 2, the liquid coolant flows from the first sub-cooling chamber 2 via the first transfer opening 11 and the second transfer openings 12*a*, 12*b*, 12*c*, 12*d* into the second sub-cooling chamber 3, and flows radially outward along the valve bridges 8*a*, 8*b*, 8*c*, 8*d* of the fire deck 5, absorbing and dissipating heat from hot spots 15 of thermally highly stressed areas.

Due to the arrangement of the second transfer openings 12*a*, 12*b*, 12*c*, 12*d*, which can be individually designed for the particular case, very high turbulence can be generated in the desired areas and cooling can thus be improved.

A further advantage is that flows S through the second transfer openings 12*a*, 12*b*, 12*c*, 12*d* are less sensitive to manufacturing tolerances than flows S through the first transfer opening 11.

Figure 4:
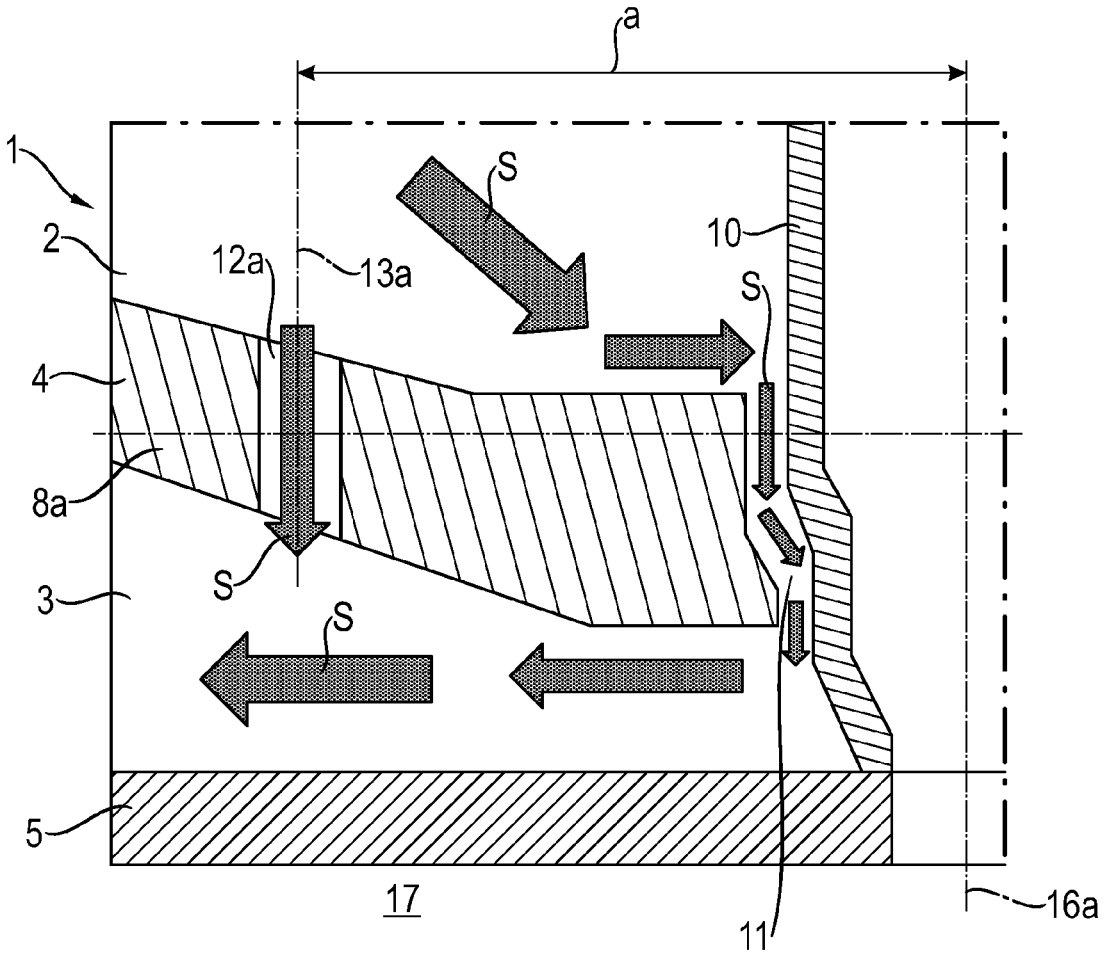
FIG. 4 shows a detail of a cylinder head according to a further embodiment.

FIG. 4 shows a detail of a further cylinder head 1 according to the invention, in which the transfer opening 11 is formed with a taper in the direction of the second sub-cooling chamber 3, allowing coolant to flow in the direction of the element. In a sectional view, the tapering transfer opening 11 consequently represents a conical annular gap.

The invention claimed is:

1. Cylinder head for an internal combustion engine having at least one cylinder, the cylinder head comprising:

a combustion chamber;

a fire deck;

an intermediate deck remote from the combustion chamber;

a central receptacle configured and arranged to receive an injection or ignition device;

at least three valve bridges;

at least two adjacent gas exchange valves;

a top-down cooling system having a first sub-cooling chamber which adjoins the intermediate deck and is remote from the combustion chamber, and a second sub-cooling chamber which adjoins the fire deck and is in close proximity to the combustion chamber;

wherein the intermediate deck is arranged between the first sub-cooling chamber and the second sub-cooling chamber; and at least one first transfer opening is arranged between the first sub-cooling chamber and the second sub-cooling chamber in the region of the central receptacle; and at least three second transfer openings between the first sub-cooling chamber and the second sub-cooling chamber are arranged in the region of the at least three valve bridges between the at least two adjacent gas exchange valves;

wherein the at least three second transfer openings includes a first second transfer opening, a second second transfer opening and a third second transfer opening, and wherein the first second transfer opening is arranged in the region of a first valve bridge of the at least three valve bridges, the second second transfer opening is arranged in the region of a second valve bridge of the at least three valve bridges, and the third second transfer opening is arranged in the region of a third valve bridge of the at least three valve bridges.

2. The cylinder head of claim 1, wherein the first sub-cooling chamber is arranged above the second sub-cooling chamber and coolant within the first sub-cooling chamber is configured and arranged to flow via the first transfer opening and at least one second transfer opening of the at least three second transfer openings in the region between the at least two adjacent gas exchange valves into the second sub-cooling chamber.

3. The cylinder head of claim 1, wherein the first transfer opening is formed with an especially continuous taper in the direction of the second sub-cooling chamber.

4. The cylinder head of claim 1, wherein at least one second transfer opening of the at least three second transfer openings is inclined in the direction of a flow direction of the coolant in the valve bridges, wherein the inclination of the at least one second transfer opening deviates from a cylinder axis by about 0° to about 45°.

5. The cylinder head of claim 4, wherein the inclination of at least one second transfer opening of the at least three second transfer openings deviates from the cylinder axis by 15° to 30°.

6. The cylinder head of claim 1, further including a hot spot of the fire deck; and wherein at least one second transfer opening of the at least three second transfer openings is arranged above the hot spot.

7. The cylinder head of claim 6, wherein the at least one second transfer opening is directed towards the hot spot.

8. The cylinder head of claim 1, wherein at least one second transfer opening of the at least three second transfer openings is parallel to a cylinder axis.

9. The cylinder head of claim 1, wherein a distance (a) between at least one second transfer opening of the at least three second transfer openings and a cylinder axis is 15% to 40% of the diameter of the cylinder.

10. The cylinder head of claim 9, wherein the distance between the at least one second transfer opening and the cylinder axis is 20-25% of the cylinder diameter.

11. The cylinder head of claim 1, wherein at least two second transfer openings of the at least three second transfer openings are equidistant from a cylinder axis.

12. The cylinder head of claim 11, wherein centers of the at least three second transfer openings lie on a circular line around the cylinder axis, the diameter of the circular line is 30% to 80%, of the diameter of the cylinder.

13. The cylinder head of claim 12, wherein the at least three second transfer openings lie on a circular line around the cylinder axis, the diameter of the circular line is 35%-50% of the cylinder diameter.

14. The cylinder head of claim 1, wherein the at least one valve bridge includes at least two valve bridges, characterized in that a distance between at least one second transfer opening of the at least three second transfer openings and a cylinder axis is less than a distance between a valve axis of at least one adjacent gas exchange valve of the at least two adjacent gas exchange valves and a cylinder axis.

15. Method for cooling a cylinder head according to claim 1, wherein coolant flows into the first sub-cooling chamber of the cylinder head, at least part of the coolant flows from the first sub-cooling chamber into the second sub-cooling chamber via the at least one first transfer opening in the region of the central receptacle for the injection or ignition device, and wherein the coolant exits the cylinder head after flowing through the second sub-cooling chamber, characterized in that at least a further part of the coolant flows from the first sub-cooling chamber via at least one second transfer opening of the at least three second transfer openings in the region of the at least one valve bridge between two adjacent gas exchange valves into the second sub-cooling chamber.

16. The cylinder head of claim 1, wherein the first transfer opening is annular, and the central receptacle is concentric with a cylinder axis of the at least one cylinder.

17. The cylinder head of claim 1, wherein the at least one valve bridge includes at least four valve bridges, and a fourth valve bridge of the at least four valve bridges is arranged in the region of at least one second transfer opening of the at least three second transfer openings.

* * * * *